US009459025B2

(12) United States Patent
Lee et al.

(10) Patent No.: US 9,459,025 B2
(45) Date of Patent: Oct. 4, 2016

(54) AIR CONDITIONING SYSTEM HAVING AN ALUMINUM HEAT EXCHANGER AND AN ALUMINUM/COPPER COUPLING

(75) Inventors: Juhyoung Lee, Seoul (KR); Seongwon Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 572 days.

(21) Appl. No.: 13/570,383

(22) Filed: Aug. 9, 2012

(65) Prior Publication Data

US 2013/0125578 A1 May 23, 2013

(30) Foreign Application Priority Data

Nov. 18, 2011 (KR) ..... 10-2011-0120899

(51) Int. Cl.

*F25B 1/00* (2006.01)
*F25B 13/00* (2006.01)
*F25B 41/00* (2006.01)

(52) U.S. Cl.

CPC ..... *F25B 13/00* (2013.01); *F25B 41/003* (2013.01); *F25B 2500/02* (2013.01); *F25B 2500/09* (2013.01); *F25B 2500/32* (2013.01)

(58) Field of Classification Search

CPC ..... F25B 13/00; F25B 41/003; F28F 9/268
USPC ..... 138/97, 99, 110; 165/180; 285/288.1–288.11, 289.1–289.5, 285/381.1–381.5; 29/447, 525.15; 403/28, 403/29, 30; 62/77, 298
See application file for complete search history.

(56) References Cited

U.S. PATENT DOCUMENTS 2,567,113 A * 9/1951 Kristensen ..... 285/342
2,741,498 A * 4/1956 Elliott ..... 285/148.11
4,023,557 A * 5/1977 Thorne et al. ..... 126/677
4,186,474 A * 2/1980 Hine ..... 29/890.047
4,709,948 A * 12/1987 Archer et al. ..... 285/381.1
4,757,595 A * 7/1988 Fraering, Jr. ..... 29/447
4,836,586 A * 6/1989 Martin ..... 285/381.3
4,872,713 A * 10/1989 Kapgan ..... 285/381.3
5,222,552 A * 6/1993 Schuchert ..... 165/172
5,842,351 A * 12/1998 Earhart, Jr. ..... 62/117
6,158,229 A * 12/2000 Aizawa ..... 62/77
6,886,349 B1 * 5/2005 Curicuta et al. ..... 62/77

(Continued)

FOREIGN PATENT DOCUMENTS

CN 101280938 A 10/2008
CN 101294646 A 10/2008
EP 1 533 154 A1 5/2005

(Continued)

OTHER PUBLICATIONS

Machine Translation for Koike et al. (JP H08-313112).*

(Continued)

*Primary Examiner* — Ryan J Walters
*Assistant Examiner* — Antonio R Febles
(74) *Attorney, Agent, or Firm* — Ked & Associates LLP

(57) ABSTRACT

An air conditioner is provided. The air conditioner may include a compressor, a condenser, an expansion device and an evaporator. The condenser or the evaporator may include a heat exchange tube formed of an aluminum material and allowing refrigerant to flow therein, and a fin connected to the heat exchange tube, the fin being formed of the same metal material as that of the heat exchange tube so as to prevent potential corrosion of the heat exchange tube.

4 Claims, 7 Drawing Sheets

(56) References Cited

U.S. PATENT DOCUMENTS

| | | | | |
|---|---|---|---|---|
| 2004/0104574 | A1* | 6/2004 | Nelson | 285/329 |
| 2011/0048053 | A1* | 3/2011 | Sekine | 62/324.6 |

FOREIGN PATENT DOCUMENTS

| | | | | | |
|---|---|---|---|---|---|
| EP | 1 693 632 | A2 | | 8/2006 | |
| EP | 2 031 314 | A2 | | 3/2009 | |
| JP | 08267228 | A | * | 10/1996 | B23K 1/18 |
| JP | 08313112 | A | * | 11/1996 | F25B 39/00 |
| JP | 11-183075 | A | | 7/1999 | |
| JP | 2003-139442 | A | | 5/2003 | |
| JP | 2005-262248 | A | | 9/2005 | |
| JP | 2010-078192 | A | | 4/2010 | |
| KR | 10-2003-0043574 | A | | 6/2003 | |
| KR | 10-2008-0095628 | A | | 10/2008 | |
| WO | WO 2012090461 | A1 | * | 7/2012 | |

OTHER PUBLICATIONS

European Search Report dated Apr. 8, 2013, issued in Application No. 12192345.2.

Chinese Office Action dated Aug. 4, 2014, issued in Application No. 201210467091.0 (English translation).

Chinese Patent Certificate dated Mar. 30, 2016 issued in Application No. 201210467091.0.

* cited by examiner

AIR CONDITIONING SYSTEM HAVING AN ALUMINUM HEAT EXCHANGER AND AN ALUMINUM/COPPER COUPLING

CROSS-REFERENCE TO RELATED APPLICATION(S)

This application claims priority under 35 U.S.C. §119 to Korean Application No. 10-2011-0120899 filed in Korea on Nov. 18, 2011, whose entire disclosure is hereby incorporated by reference.

BACKGROUND

1. Field

This relates to an air conditioner.

2. Background

Air conditioners maintain indoor air at predetermined states according to desired purposes and preferences. For example, air conditioners may be used to keep indoor air cool in summer and warm in winter. In addition, air conditioners may adjust the humidity of indoor air to provide a pleasant and clean environment.

Indoor air may be cooled or heated by an air conditioner depending on how the air conditioner is operated in a refrigeration cycle. That is, the direction of a refrigerant flowing in refrigeration cycle may be varied based on whether cooling operation or a heating operation is selected.

A refrigeration cycle may include a compressor, an outdoor heat exchanger, an expansion device, and an indoor heat exchanger. In cooling mode, a refrigerant discharged from the compressor is condensed by the outdoor heat exchanger and is expanded (decompressed) by the expansion device. Then, the refrigerant is evaporated in the indoor heat exchanger and is guided back to the compressor.

In heating mode, the refrigerant discharged from the compressor is condensed by the indoor heat exchanger and is expanded by the expansion device. Then, the refrigerant is evaporated in the outdoor heat exchanger and guided back to the compressor.

BRIEF DESCRIPTION OF THE DRAWINGS

The embodiments will be described in detail with reference to the following drawings in which like reference numerals refer to like elements wherein.

DETAILED DESCRIPTION

Hereinafter, embodiments will be described with reference to the accompanying drawings. However, the spirit and scope set forth are not limited to the embodiments presented herein. Other embodiments within the spirit and scope may be well understood by one or ordinary skill in the art.

Air conditioners may include refrigerant tubes to circulate refrigerant, and distributors to distribute the refrigerant from one component to another in a refrigeration cycle. Copper refrigerant tubes may provide good reliability and thermal expansion characteristic. However, outdoor and indoor heat exchangers include many refrigerant tubes, and copper may be relatively expensive and heavy, consequently rendering such air conditioners heavy and expensive.

Heat exchangers may also include heat dissipating fins coupled to the refrigerant tubes for facilitating heat exchange between refrigerant in the tubes and external air. Such heat dissipating fins may be formed of aluminum that, which is light and has good thermal conductivity. However, in such an arrangement, refrigerant tubes and heat dissipating fins would be formed of different metals, and thus the refrigerant tubes and/or heat dissipating fins may be subject to corrosion.

Figure 1:
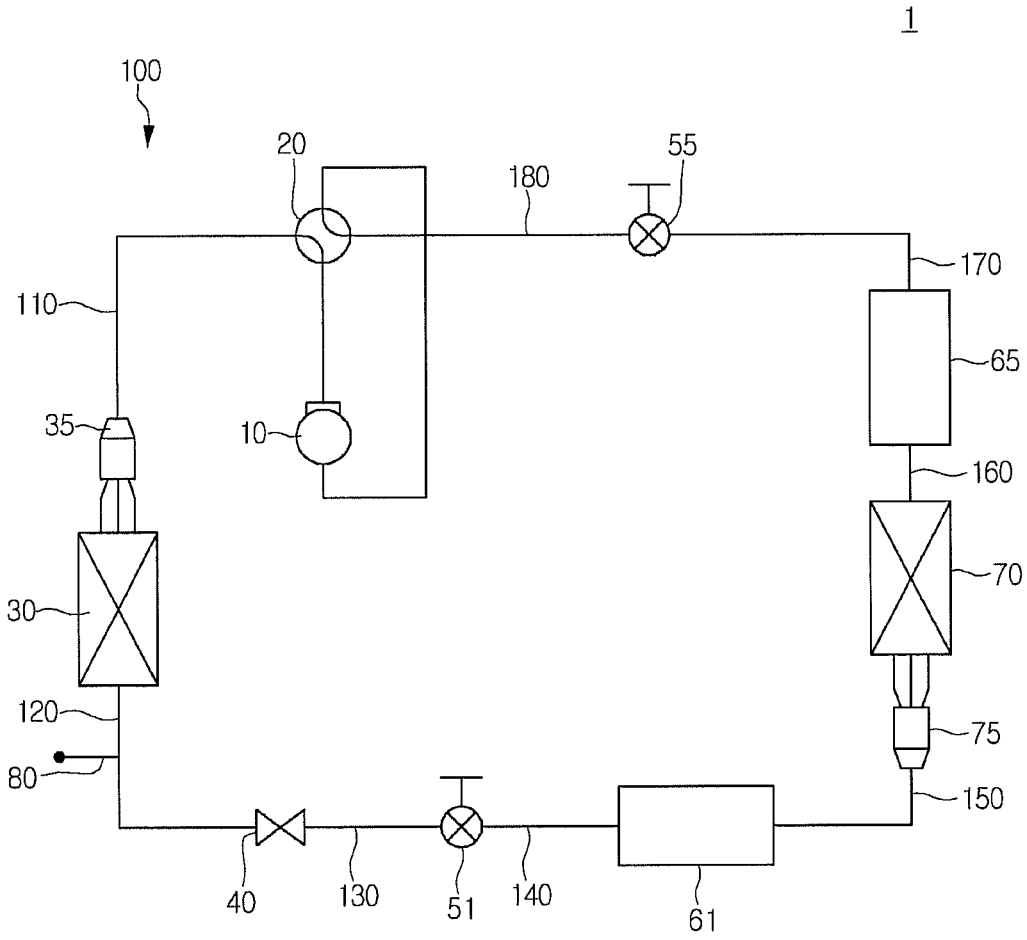
FIG. 1 is a schematic view of a refrigerant cycle of an air conditioner according to an embodiment as broadly described herein.

FIG. 1 is a schematic view of a refrigerant cycle of an air conditioner 1 as broadly described herein. In the following description, the terms "entrance side" and "exit side" are used based on a refrigerant flow direction.

Referring to FIG. 1, the air conditioner 1 may include a compressor 10, a flow switch 20, an outdoor heat exchanger 30, an expansion device 40, and an indoor heat exchanger 70. The compressor 10 compresses refrigerant. The flow switch 20 guides the refrigerant from the compressor 10 to the outdoor heat exchanger 30 or the indoor heat exchanger 70. The outdoor heat exchanger 30 may be provided in an outdoor area for heat exchange with outdoor air. The expansion device 40 may reduce the pressure of the refrigerant. The indoor heat exchanger 70 may be provided in an indoor area for heat exchange with indoor air.

The circulation direction of the refrigerant may be varied based on whether the air conditioner is operated in the cooling mode or the heating mode. In cooling mode, the refrigerant discharged from the compressor 10 flows through the outdoor heat exchanger 30, the expansion device 40, and the indoor heat exchanger 70, and then returns to the compressor 10. In this situation, the outdoor heat exchanger 30 functions as a condenser, and the indoor heat exchanger 70 functions as an evaporator.

In heating mode, the refrigerant discharged from the compressor 10 flows through the indoor heat exchanger 70, the expansion device 40, and the outdoor heat exchanger 30, and then returns to the compressor 10. In this situation, the indoor heat exchanger 70 functions as a condenser, and the outdoor heat exchanger 30 functions as an evaporator.

Hereinafter, an explanation will be provided of an exemplary case in which the air conditioner 1 is operated in cooling mode.

The air conditioner 1 may include refrigerant tubes 100 to guide refrigerant flow. The refrigerant tubes 100 may include a plurality tubes, such as first to eighth tubes 110, 120, 130, 140, 150, 160, 170 and 180.

The outdoor heat exchanger 30 and/or the indoor heat exchanger 70 may include fins (heat exchange fins) coupled to the refrigerant tubes 100 for facilitating heat transfer to or from the refrigerant. The refrigerant tubes 100 provided at the outdoor heat exchanger 30 and/or the indoor heat exchanger 70 may be referred to as heat exchange tubes.

The refrigerant tubes 100 and the fins may be formed of an aluminum material, so that the weight of the outdoor heat exchanger 30 and/or the indoor heat exchanger 70 may be reduced compared to a heat exchanger including a plurality of copper tubes.

In addition, since the refrigerant tubes 100 and the fins are formed of the same metal, the refrigerant tubes 100 and/or the fins may be protected from corrosion caused by a potential difference between dissimilar metals. Owing to this, the lifespan of the outdoor heat exchanger 30 and/or the indoor heat exchanger 70 may be increased, and power consumption may be reduced.

A first distributor 35 and the first tube 110 may be provided at an entrance side of the outdoor heat exchanger 30. The first distributor 35 may distribute refrigerant to a plurality of refrigerant tubes of the outdoor heat exchanger 30, and the first tube 110 may extend from the flow switch 20 to the first distributor 35. The refrigerant may be introduced into the outdoor heat exchanger 30 through the first distributor 35 and may be discharged from the outdoor heat exchanger 30 through the first distributor 35 after circulating through the outdoor heat exchanger 30.

In certain embodiments, the first distributor 35 may be formed of an aluminum material, and the first tube 110 may be formed of a copper material. In this case, the first distributor 35 formed of an aluminum material may be light, and the first tube 110 formed of a copper material may be less thermally expanded by the refrigerant discharged from the compressor 10 at a relatively high temperature.

The second tube 120 may extend from a discharge side of the outdoor heat exchanger 30 to the expansion device 40, and a refrigerant injector 80 may be disposed at the second tube 120 for injecting refrigerant in the air conditioner 1. The refrigerant injector 80 may include a predetermined tube.

The second tube 120 may include a tube formed of an aluminum material (hereinafter referred to as an aluminum tube), and a tube formed of a copper material (hereinafter referred to as a copper tube). Such a tube including aluminum and copper tubes may be referred to as a combination tube, or a hybrid tube.

In certain embodiments, at least a portion of the second tube 120 may be formed of an aluminum material, and the remaining portion of the second tube 120 may be formed of a copper material. The aluminum tube and the copper tube may be coupled to each other by numerous different coupling mechanisms, such as, for example, by welding, by a coupling tube, or other mechanism as appropriate.

Since the second tube 120 is a combination tube, or hybrid tube, the weight of the second tube 120 may be reduced, and the quality of the second tube 120 may be improved owing to thermal conductivity or anti-corrosion characteristics of a copper material.

The refrigerant injector 80 may be disposed at the copper tube of the second tube 120. In an exemplary air conditioner, such a refrigerant may already be provided at a copper tube, i.e., at the second tube 120 without additional costs or processes.

A first service valve 51 and the third tube 130 may be provided at an exit side of the expansion device 40, with the third tube 130 extending from the expansion device 40 to the first service valve 51. The third tube 130 may include a copper tube and an aluminum tube.

A service valve may be used to inject refrigerant in an air conditioner when the air conditioner is first installed. Such a service valve may also be used to collect refrigerant from the air conditioner when the air conditioner is uninstalled. The exemplary air conditioner 1 shown in FIG. 1 includes the first service valve 51 and a second service valve 55. The refrigerant may flow from the outdoor heat exchanger 30 to an indoor unit (that is, the indoor heat exchanger 70) through the first service valve 51. In addition, the refrigerant may flow from the indoor unit to the compressor 10 through the second service valve 55.

The air conditioner 1 may include a plurality of connectors 61 and 65 for connecting an outdoor unit and the indoor unit. The outdoor unit may include the compressor 10, the outdoor heat exchanger 30, and the expansion device 40, and the indoor unit may include the indoor heat exchanger 70.

The connectors 61 and 65 may include a first connector 61 configured to connect refrigerant tubes between the outdoor heat exchanger 30 and the indoor heat exchanger 70, and a second connector 65 configured to connect refrigerant tubes between the outdoor heat exchanger 30 and the compressor 10.

The fourth tube 140 extends between the first service valve 51 and the first connector 61. Since the fourth tube 140 may be exposed to the outside, the fourth tube 140 may be formed of a copper tube having a low thermal deformation or expansion rate. Similarly, the seventh tube 170 extending between the second connector 65 and the second service valve 55 may be a copper tube.

A second distributor 75 is disposed at a side of the indoor heat exchanger 70 to distribute the refrigerant discharged from the expansion device 40 to a plurality of refrigerant tubes of the indoor heat exchanger 70. The refrigerant may be introduced into the indoor heat exchanger 70 through the second distributor 75 and discharged from the indoor heat exchanger 70 through the second distributor 75.

The fifth tube 150 extends between the first connector 61 and the second distributor 75, and the sixth tube 160 extends between the indoor heat exchanger 70 and the second connector 65. At least one of the fifth tube 150 or the sixth tube 160 may be a combination tube.

The eighth tube 180 extends between the second service valve 55 and the flow switch 20. The eighth tube 180 may be a copper tube or an aluminum tube.

Figure 2:
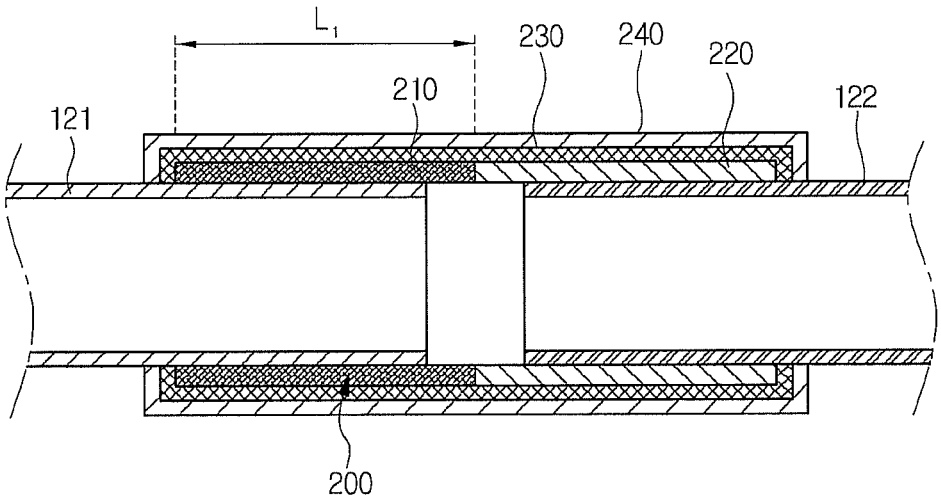
FIG. 2 is a sectional view of a coupled state of an aluminum tube and a copper tube according to an embodiment as broadly described herein.

FIG. 2 is a sectional view of a coupled state of an aluminum tube and a copper tube according to a first embodiment. With reference to FIG. 2, the second tube 120 will be explained as an exemplary combination tube of the first embodiment.

The second tube 120 may include an aluminum tube 121, a copper tube 122, and a coupling tube 200. The coupling tube 200 may be a separate tube for coupling the aluminum tube 121 and the copper tube 122. The aluminum tube 121 and the copper tube 122 may be inserted in the coupling tube 200.

The coupling tube 200 may include a first metal part 210 and a second metal part 220 which may be formed of different metal materials. In detail, in this embodiment, at least a portion of the coupling tube 200 is formed of the first metal part 210, and the other portion of the coupling tube 200 is formed of the second metal part 220. In this exemplary embodiment, the first metal part 210 is formed of aluminum, and the second metal part 220 is formed of copper.

The first metal part 210 makes contact with the aluminum tube 121, and the second metal part 220 makes contact with the copper tube 122. That is, the aluminum tube 121 makes contact with the first metal part 210 formed of an aluminum material, and the copper tube 122 makes contact with the second metal part 220 formed of a copper material.

Generally, if different kinds of metals contact each other, the metals may be subject to corrosion in certain environments due to a potential difference between the metals. The potential of a metal having high ionization tendency is relatively low. Therefore, if a metal having a low potential makes contact with a metal having a high potential, the metal having a low potential is corroded. A potential of aluminum is lower than that of copper.

However, according to the first embodiment, when the aluminum tube 121 and the copper tube 122 are coupled to each other by the coupling tube 200, since the same kinds of metals contact each other, corrosion caused by a potential difference between different metals may be reduced.

The first metal part 210 making contact with the aluminum tube 121 may have a preset length L1. Since the corrosion resistance of aluminum is lower than that of copper, the first metal part 210 disposed around the aluminum tube 121 may have a length that is sufficient to delay breakage of the first metal part 210. The length L1 may be, for example, 30 mm or greater.

In a state where the aluminum tube 121 and the copper tube 122 are inserted in the coupling tube 200, ends of the aluminum tube 121 and the copper tube 122 may be spaced apart from each other, as shown in FIG. 2. That is, since the aluminum tube 121 and the copper tube 122 are not in contact with each other, corrosion caused by a potential difference between different metals may be prevented.

A seal 240 may be provided around the coupling tube 200 to protect the coupling tube 200, the aluminum tube 121, and the copper tube 122 from moisture or water, and an adhesive layer 230 may be provided between the seal 240 and the coupling tube 200.

If a certain amount of heat is supplied to the adhesive layer 230, the adhesive layer 230 may be fixed between the seal 240 and the coupling tube 200. The seal 240 may be, for example, a tube made of, for example, rubber or plastic, tape, a member formed of a solidified liquid material, or other material(s) as appropriate.

A method of manufacturing the combination tube will now be explained.

The aluminum tube 121 and the copper tube 122 may be inserted in the coupling tube 200. Next, an adhesive may be placed around the coupling tube 200, and then the seal 240 may be positioned around the coupling tube 200.

Thereafter, heat may be supplied to the adhesive and the seal 240, causing the seal 240 to shrink inward to press the coupling tube 200 toward the aluminum tube 121 and the copper tube 122.

In this way, the aluminum tube 121, the copper tube 122, the coupling tube 200, and the seal 240 may be reliably sealed to prevent permeation of moisture and corrosion.

Hereinafter, second to fourth embodiments will be described. Differences with the foregoing embodiment will be mainly described, and the same or similar elements as those of the first embodiment will be denoted by the same reference numerals where appropriate.

Figure 3:
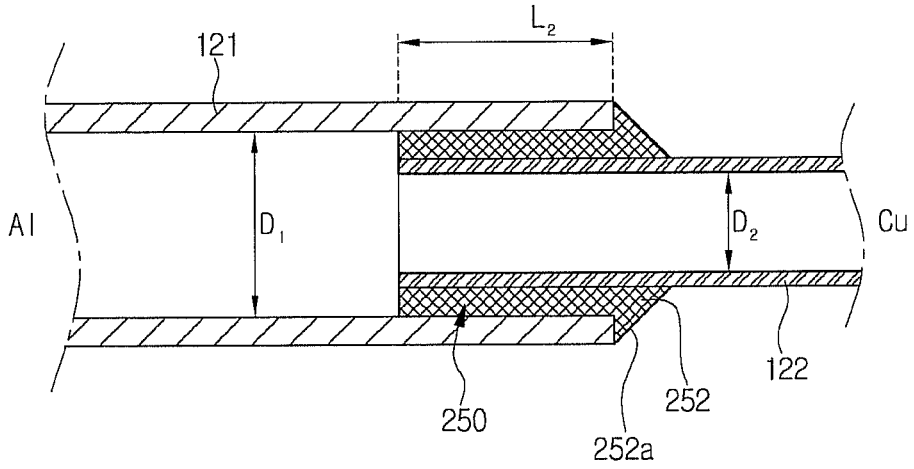
FIG. 3 is a sectional view of a coupled state of an aluminum tube and a copper tube according to another embodiment as broadly described herein.

Referring to FIG. 3, according to the second embodiment, an aluminum tube 121 and a copper tube 122 may be coupled without an additional member such as the coupling tube 200 shown in FIG. 2.

In detail, a tube joint may include the aluminum tube 121 having a predetermined inner diameter D1, the copper tube 122 having an inner diameter D2 smaller than the inner diameter D1 and inserted in the aluminum tube 121, and a welding layer 250 provided in an area between the inserted portion of the copper tube 122 and a corresponding portion of the aluminum tube 121.

Since the aluminum tube 121 is disposed around the copper tube 122, although the aluminum tube 121 and the copper tube 122 could react with each other due to a potential difference and corrode the aluminum tube 121, the tube joint may instead be damaged from the outside of the tube joint, and thus refrigerant flowing in the tube joint may not be affected, and leakage of the refrigerant may be prevented.

On the other hand, if the aluminum tube 121 is disposed in the copper tube 122, the tube joint may be damaged from the inside of the tube joint due to corrosion of the aluminum tube 121. Thus, refrigerant flowing in the tube joint may be affected and may leak.

Therefore, in the current embodiment, the aluminum tube 121 is disposed around the copper tube 122. That is, the copper tube 122 is inserted in the aluminum tube 121.

The copper tube 122 is inserted in the aluminum tube 121 by a length L2. That is, the length of the inserted portion of the copper tube 122 measured from an end of the aluminum tube 121 is L2 such that the aluminum tube 121 and the copper tube 122 overlap by a length L2, separated by the welding layer 250. The length L2 may be, for example, 9 mm or greater.

The welding layer 250 is disposed between the inner surface of the aluminum tube 121 and the outer surface of the copper tube 122 at a position corresponding to the length L2.

The welding layer 250 may be formed of a welding material applied with heat. A potential of the welding material may be lower than that of aluminum or copper. That is, the ionization tendency of the welding material may be higher than that of aluminum or copper. Therefore, if the aluminum tube 121, the copper tube 122, and the welding layer 250 react with each other due to a potential difference, the welding layer 250 is corroded. In certain embodiments, the welding layer 250 may be, for example, aluminum with flux, an alloy of copper with nickel, zinc and/or tin, or other material as appropriate applied by, for example, brazing welding or other method as appropriate.

By sufficiently increasing the insertion length L2 of the copper tube 122 and disposing the welding layer 250 between the aluminum tube 121 and the copper tube 122, corrosion or breakage of the aluminum tube 121 and the copper tube 122 may be prevented, even though the welding layer 250 may be corroded.

The welding layer 250 may include a protrusion 252 to cover the end of the aluminum tube 121. The protrusion 252 may include a slope 252*a* extending from the end of the aluminum tube 121 to the outer surface of the copper tube 122.

Since the protrusion 252 of the welding layer 250 is disposed between the end of the aluminum tube 121 and the outer surface of the copper tube 122, corrosion of the aluminum tube 121 may be avoided.

Figure 4:
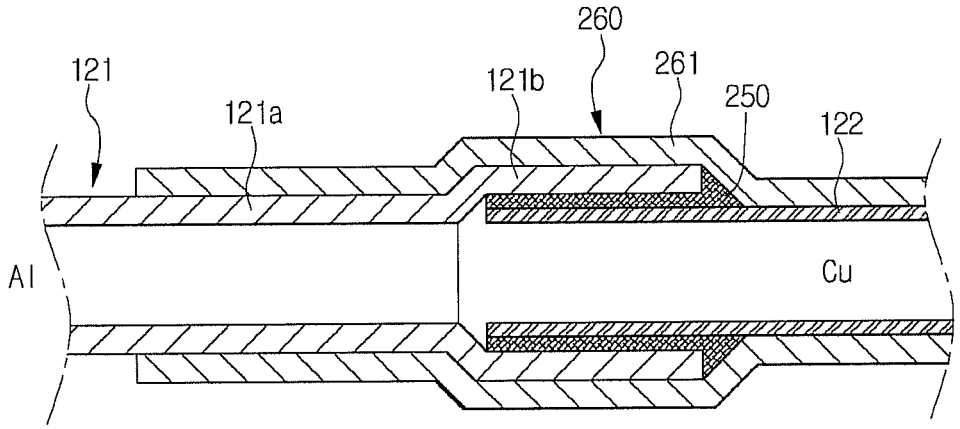
FIG. 4 is a sectional view of a coupled state of an aluminum tube and a copper tube according to another embodiment as broadly described herein.

FIG. 4 is a sectional view of a coupled state of an aluminum tube and a copper tube according to a third embodiment. In the third embodiment, an aluminum tube and a copper tube are directly coupled to form a tube joint.

Referring to FIG. 4, according to the third embodiment, an aluminum tube 121 may include a tube main body 121*a* and an enlarged tube portion 121*b*. The tube main body 121*a* forms a refrigerant flow passage. The enlarged tube portion 121*b* is formed on an end of the tube main body 121*a* and has an inner diameter greater than that of the tube main body 121*a*.

A copper tube 122 is inserted in the enlarged tube portion 121*b*. A welding layer 250 is disposed between the enlarged tube portion 121*b* and an inserted portion of the copper tube 122. That is, the enlarged tube portion 121*b* of the aluminum tube 121 functions as a coupling portion for the tube joint.

The inner diameter of the tube main body 121*a* is approximately equal to the inner diameter of the copper tube 122. Therefore, when the aluminum tube 121 and the copper tube 122 are coupled, the inner surface of the tube joint may be substantially smooth without a stepped portion to reduce flow resistance when a refrigerant flows in the tube joint.

A cover 260 may be disposed around the aluminum tube 121 to prevent permeation of humidity or moisture into the tube joint. In a state where the aluminum tube 121 and the copper tube 122 are coupled to each other, the cover 260 surrounds the aluminum tube 121 and the copper tube 122. The cover 260 may include a cover enlarged portion 261.

In the current embodiment, at the tube joint, the aluminum tube 121 is disposed around the copper tube 122 as described in the second embodiment. Therefore, breakage of the tube joint may be prevented, and refrigerant leakage may be prevented.

Figure 5:
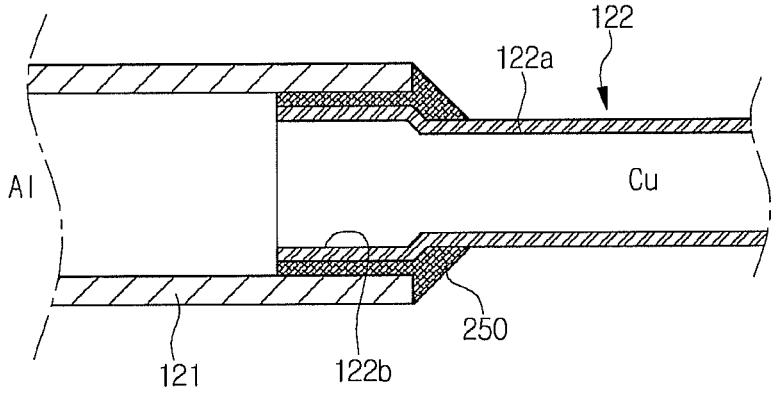
FIG. 5 is a sectional view of a coupled state of an aluminum tube and a copper tube according to another embodiment as broadly described herein.

FIG. 5 is a sectional view of a coupled state of an aluminum tube and a copper tube according to a fourth embodiment.

Referring to FIG. 5, according to the fourth embodiment, a copper tube 122 includes a tube main body 122*a* and an enlarged tube portion 122*b*. The tube main body 122*a* forms a refrigerant flow passage. The enlarged tube portion 122*b* is formed on an end of the tube main body 122*a* for coupling with the aluminum tube 121. That is, the enlarged tube portion 122*b* functions as a coupling portion.

A welding layer 250 is disposed between an end part of the aluminum tube 121 and the enlarged tube portion 122*b*. A cover such as, for example, the cover 260 shown in FIG. 4, may be used in the current embodiment.

In the current embodiment, at the tube joint, the aluminum tube 121 is disposed around the copper tube 122 as described in the previous embodiments. Therefore, breakage of the tube joint may be prevented, and refrigerant leakage may be prevented.

Figure 6:
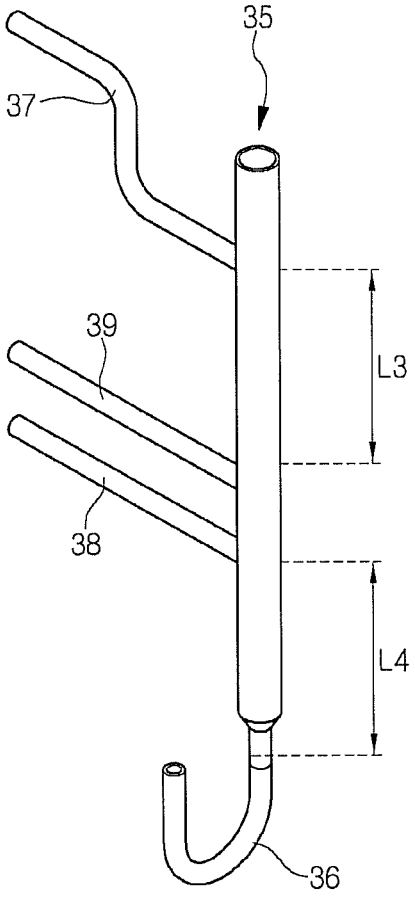
FIG. 6 is a perspective view of a distributor according to an embodiment as broadly described herein.

FIG. 6 is a perspective view illustrating tubing of a distributor 35 (see also, FIG. 1) according to an embodiment, as broadly described herein.

Referring to FIG. 6, the distributor 35 may include a first inlet/outlet tube 36, a second inlet/outlet tube 37, a first branch tube 38, and a second branch tube 39. Refrigerant is introduced into the distributor 35 through the first and second inlet/outlet tubes 36 and 37 and is discharged from the distributor 35 through the first and second inlet/outlet tubes 36 and 37. Refrigerant is distributed to the outdoor heat exchanger 30 or the indoor heat exchanger 70 from the distributor 35 through the first and second branch tubes 38 and 39.

The first and second inlet/outlet tubes 36 and 37 and the first and second branch tubes 38 and 39 may be coupled to the distributor 35 by welding. The first and second inlet/outlet tubes 36 and 37 and the first and second branch tubes 38 and 39 may be formed of different metal materials, and/or may be combination/hybrid tubes as previously discussed.

In one exemplary embodiment, the distributor 35 may be formed of an aluminum material. The first and second inlet/outlet tubes 36 and 37 may be formed of copper, and the first and second branch tubes 38 and 39 may be formed of aluminum. Alternatively, the first and second inlet/outlet tubes 36 and 37 may be formed of aluminum, and the first and second branch tubes 38 and 39 may be formed of copper.

In this way, if refrigerant tubes formed of different metals are coupled to the distributor 35 at neighboring positions, the neighboring refrigerant tubes formed of different metals may be spaced by predetermined distances L3, L4.

If tubes formed of different metals are welded, welding errors may occur due to different melting points of the different metals. That is, the distances L3 and L4 may be considered as minimum distances for preventing welding errors. The distances L3 and L4 may be, for example, 30 mm or greater.

In other words, different kinds of refrigerant tubes may be welded to the distributor 35 at positions spaced apart from each other by a predetermined length or more to provide for acceptable welding quality.

Figure 7:
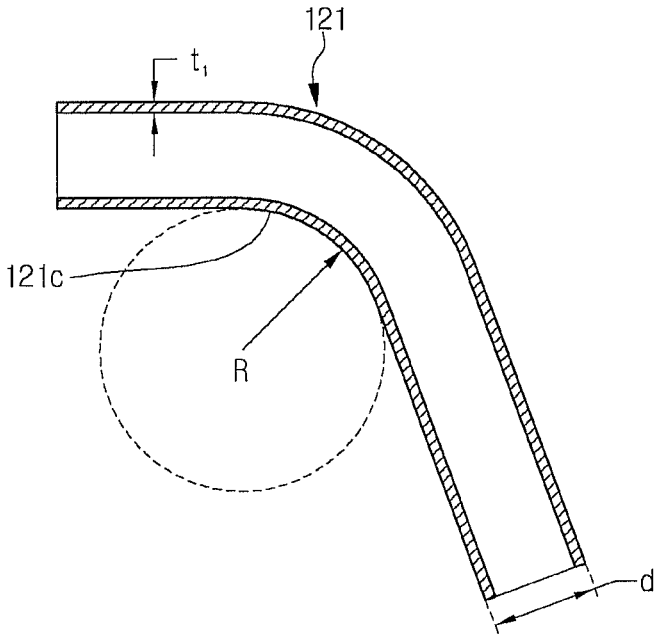
FIG. 7 is a sectional view of an aluminum tube according to an embodiment as broadly described herein.

FIG. 7 is a cross-sectional view of a bent state of an aluminum tube according to an embodiment. A refrigerant tube may be bent or rounded to properly/efficiently position the refrigerant tube in an air conditioner.

Referring to FIG. 7, according to the embodiment, an aluminum tube 121 may include a bent portion 121*c*. The bent portion 121*c* may be rounded with a predetermined radius of curvature R.

In certain instances, the aluminum tube 121 may be damaged due to accumulation of fatigue. To prevent this, the radius of curvature R and thickness t1 of the aluminum tube 121 may be established to prevent such damage.

For example, in certain embodiments, the radius of curvature R of the aluminum tube 121 may be greater than twice the diameter d of the aluminum tube 121, and the thickness t1 of the aluminum tube 121 may be greater than 0.1 times the diameter d of the aluminum tube 121 ($t1>0.1*d$). In this case, the fatigue lifespan of the aluminum tube 121 may be 10 years or longer.

According to the embodiments as broadly described herein, the refrigerant tube connecting one component to another component in refrigerant cycle may be formed of aluminum. Therefore, the weight and manufacturing cost of the air conditioner may be reduced. Since the weight of the air conditioner is reduced, the air conditioner (particularly, the outdoor unit of the air conditioner) may be easily installed and stably reinstalled.

In addition, since the refrigerant tube and the fin of the heat exchanger may be formed of aluminum, corrosion caused by a potential difference between different kinds of metals may be prevented.

In addition, since aluminum may be recycled, the air conditioner may be recycled or reused for other purposes.

In addition, since the refrigerant tube may be a combination tube including aluminum and copper materials, the weight of the refrigerant tube may be reduced, and the quality of the refrigerant tube may be improved owing to thermal conductivity and/or anti-corrosion characteristics of copper.

In addition, since aluminum and copper materials may be firmly combined by welding or using a coupling tube, coupling and anti-corrosion characteristics of the refrigerant tube may be improved, and the lifespan of the refrigerant tube may be increased.

In addition, welding errors caused by different melting points of aluminum and copper materials may be prevented by spacing a welding portion of aluminum materials away from a welding portion for aluminum and copper materials.

Furthermore, when it is necessary to bend an aluminum refrigerant tube, the radius of curvature and/or thickness of the aluminum refrigerant tube may be selected in consideration of fatigue characteristics of aluminum. Thus, the lifespan of the aluminum refrigerant tube may be increased.

According to the embodiments as broadly described herein, owing to the refrigerant tubes formed of aluminum, the weight and manufacturing costs of the air conditioner may be reduced. Therefore, the air conditioner may be applied to various industrial fields.

Embodiments as broadly described herein provide an air conditioner that may be easily installed and which may be manufactured at a relatively low cost.

In one embodiment, an air conditioner as embodied and broadly described herein may include a compressor configured to compress a refrigerant; a condenser at which the refrigerant discharged from the compressor exchanges heat; an expansion device configured to decompress the refrigerant after the refrigerant passing through the condenser; and an evaporator at which the refrigerant decompressed by the expansion device exchanges heat, wherein the condenser or the evaporator includes: a heat exchange tube formed of an aluminum material and allowing the refrigerant to flow therein; and a heat dissipating fin connected to the heat exchange tube, the heat dissipating fin being formed of the same metal material used to form the heat exchange tube for preventing corrosion of the heat exchange tube caused by a potential difference.

In another embodiment, an air conditioner as embodied and broadly described herein may include a refrigerant tube connecting a plurality of components in refrigerant cycle to guide a flow of refrigerant; and an heat exchanger including a heat exchange tube and a heat dissipating fin, the heat exchange tube being defined by at least a portion of the refrigerant tube, the heat dissipating fin being formed of the same metal material as that used to form the heat exchange tube, wherein at least a portion of the refrigerant tube includes an aluminum tube.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a plurality of components; and a refrigerant tube configured to connect the plurality of components to form a refrigerant cycle therebetween, the plurality of components including a heat exchanger, the heat exchanger including:

a plurality of heat exchange tubes formed of a metal material; and at least one fin coupled to at least one of the plurality of heat exchange tubes and formed of a same material as the material of the plurality of heat exchange tubes, wherein at least a portion of the at least one heat exchange tube is defined by a portion of the refrigerant tube, and at least a portion of the refrigerant tube includes an aluminum tube, wherein the refrigerant tube includes:

a combination tube in which the aluminum tube and a copper tube are coupled, the aluminum tube and the copper tube being aligned end to end with a space formed between corresponding ends; and a coupling tube that couples the aluminum tube and the copper tube, the coupling tube including:

a first metal tube formed of a same material as a material of the aluminum tube to surround at least a portion of the aluminum tube;

a second metal tube formed of a same material as a material of the copper tube to surround at least a portion of the copper tube;

a seal that surrounds the first and second metal tubes to cover surfaces of the first and the second metal tubes; and an adhesive layer provided between the first and second metal tubes and the seal, wherein the adhesive layer encloses entire outer circumferential surfaces of the first and second metal tubes, and wherein the seal encloses an outer circumferential surface of the adhesive layer to prevent permeation of moisture into the first and second metal tubes and corrosion, wherein the plurality of components further includes a distributor to distribute refrigerant to the plurality of heat exchange tubes, the distributor including;

a body having a cylindrical shape;

a first aluminum tube welded at an upper portion of the body at a first welding area;

a first copper tube welded at a first intermediate portion of the body at a second welding area;

a second copper tube welded at a second intermediate portion of the body at a third welding area; and a second aluminum tube welded at a lower portion of the body at a fourth welding area, wherein a distance from the first welding area to the second welding area is greater than a distance between the second and third welding areas, and wherein a distance from the third welding area to the fourth welding area is greater than the distance between the second and third welding areas.

2. The air conditioner of claim 1, wherein the seal is a heat shrink seal that presses the coupling tube toward the aluminum tube and the copper tube.

3. The air conditioner of claim 1, wherein the distance from the first welding area to the second welding area or the distance from the third welding area to the fourth welding area is greater than or equal to 30 mm.

4. The air conditioner of claim 1, wherein the aluminum tube includes a bent portion having a predetermined radius of curvature, wherein the predetermined radius of curvature of the bent portion is greater than twice a diameter of the aluminum tube, and wherein a thickness of the aluminum tube is greater than 0.1 times the diameter of the aluminum tube.

* * * * *